US006712100B2

(12) United States Patent
Yook et al.

(10) Patent No.: US 6,712,100 B2
(45) **Date of Patent: *Mar. 30, 2004**

(54) SEAMED PAPERMAKER'S FABRICS

(75) Inventors: Steven S. Yook, South Glens Falls, NY (US); Phillip R. Elkins, Goose Creek, SC (US)

(73) Assignee: Albany International Corp., Albany, NY (US)

( * ) Notice: Subject to any disclaimer, the term of this patent is extended or adjusted under 35 U.S.C. 154(b) by 22 days.

This patent is subject to a terminal disclaimer.

(21) Appl. No.: 10/008,061

(22) Filed: Oct. 19, 2001

(65) Prior Publication Data

US 2002/0115368 A1 Aug. 22, 2002

Related U.S. Application Data

(60) Provisional application No. 60/242,693, filed on Oct. 23, 2000.

(51) Int. Cl.[7] ..... D03J 3/04
(52) U.S. Cl. ..... 139/383 A; 139/383 AA
(58) Field of Search ..... 139/383 A, 383 AA

(56) References Cited

U.S. PATENT DOCUMENTS 5,601,877 A * 2/1997 Miller et al. ..... 427/373
5,732,749 A 3/1998 Fargeout
5,746,257 A * 5/1998 Fry ..... 139/383 AA
5,939,176 A * 8/1999 Yook ..... 428/193
6,162,518 A * 12/2000 Korfer ..... 428/60
6,176,271 B1 * 1/2001 Sayers et al. ..... 139/383 AA
6,194,331 B1 * 2/2001 Elkins ..... 442/225
6,265,048 B1 * 7/2001 Rydin et al. ..... 428/121
6,302,155 B1 * 10/2001 Rydin ..... 139/383 AA

FOREIGN PATENT DOCUMENTS

EP 0 695 827 A2 6/1995
EP 0 940 499 A2 3/1999

* cited by examiner

*Primary Examiner*—John J. Calvert
*Assistant Examiner*—Robert H. Muromoto, Jr.
(74) *Attorney, Agent, or Firm*—Frommer Lawrence & Haug, LLP; Ronald R. Santucci

(57) ABSTRACT

An on-machine-seamable papermaker's fabric includes a base fabric having seaming loops at its widthwise edges for joining the papermaker's fabric into endless form on a paper machine. The seam formed when the seaming loops are interdigitated and joined to one another with a pintle is covered with a strip of flow-resistant material, or, where the base fabric is a laminated structure having a top layer and a bottom layer, strips of flow-resistant material are placed between the top and bottom layers adjacent to the seam. The flow-resistant material provides the seam region with permeabilities to air and water substantially identical to those of the rest of the papermaker's fabric. At least one layer of staple fiber batt is entangled through the base fabric and flow-resistant material.

16 Claims, 4 Drawing Sheets

SEAMED PAPERMAKER'S FABRICS

CROSS-REFERENCE TO RELATED APPLICATION

This application is based upon U.S. Provisional Patent Application Serial No. 60/242,693 filed Oct. 23, 2000 entitled "Seamed Papermaker's Fabrics".

BACKGROUND OF THE INVENTION

1. Field of the Invention

The present invention relates to the papermaking arts. More specifically, the present invention is a papermaker's fabric of the on-machine-seamable variety, such as an on-machine-seamable press fabric for the press section of a paper machine.

2. Description of the Prior Art

During the papermaking process, a fibrous web is formed by depositing a fibrous slurry, that is, an aqueous dispersion of cellulose fibers, on a moving forming fabric in the forming section of a paper machine. A large amount of water is drained from the slurry through the forming fabric during this process, leaving the fibrous web on the surface of the forming fabric.

The newly formed web proceeds from the forming section to a press section, which includes a series of press nips. The fibrous web passes through the press nips supported by a press fabric, or, as is often the case, between two press fabrics. In the press nips, the fibrous web is subjected to compressive forces which squeeze water therefrom, and which adhere the fibers in the web to one another to turn the fibrous web into a sheet. The water is accepted by the press fabric or fabrics and, ideally, does not return to the web.

The web finally proceeds to a dryer section, which includes at least one series of rotatable dryer drums or cylinders, which are internally heated by steam. The web, or newly formed paper sheet, itself is directed in a sinuous path sequentially around each in the series of drums by a dryer fabric, which holds the web closely against the surfaces of the drums. The heated drums reduce the water content of the web to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speed. That is to say, the fibrous slurry is continuously deposited onto the forming fabric in the forming section, while a newly manufactured paper sheet is continuously wound onto rolls after it exits from the dryer section.

Referring, for the moment, specifically to press fabrics, it should be recalled that, at one time, press fabrics were supplied only in endless form. This is because a newly formed paper sheet is extremely susceptible to marking in the press nip by any nonuniformity in the press fabric or fabrics. An endless, seamless fabric, such as one produced by the process known as endless weaving, has a uniform structure in both its longitudinal (machine) and transverse (cross-machine) directions. A seam, such as a seam which may be used to close the press fabric into endless form during installation on a paper machine, represents a discontinuity in the uniform structure of the press fabric. The use of a seam, then, greatly increases the likelihood that the paper sheet will be marked in the press nip.

In brief, the seam region of any workable on-machine-seamable, or OMS®, press fabric must behave under load, that is, under compression in the press nip or nips, like the rest of the press fabric, and must have the same permeability to water and to air as the rest of the press fabric, in order to prevent the periodic marking of the paper product being manufactured by the seam region. OMS® is a registered trademark of Albany International Corp.

Despite the considerable technical obstacles presented by these requirements, it remained highly desirable to develop an on-machine-seamable press fabric, because of the comparative ease and safety with which it could be installed on the press section. Ultimately, these obstacles were overcome with the development of press fabrics having seams formed by providing seaming loops on the crosswise edges of the two ends of the fabric. The seaming loops themselves are formed by the machine-direction (MD) yarns of the fabric. A seam is formed by bringing the two ends of the press fabric together, by interdigitating the seaming loops at the two ends of the fabric, and by directing a so-called pin, or pintle, through the passage defined by the interdigitated seaming loops to lock the two ends of the fabric together. Needless to say, it is much easier and far less time-consuming to install an on-machine-seamable press fabric, than it is to install an endless press fabric, on a paper machine.

There are several methods for producing a press fabric that can be joined on the paper machine with such a seam. One method is to flat-weave the fabric, in which case the warp yarns are the machine-direction (MD) yarns of the press fabric. To form the seaming loops, the warp ends are woven some distance back into the fabric body in a direction parallel to the warp yarns. Another technique, far more preferable, is a modified form of endless weaving, which normally is used to produce an endless loop of fabric. In modified endless weaving, the weft, or filling, yarns are continuously woven back and forth across the loom, in each passage forming a loop on one of the edges of the fabric being woven by passing around a loop-forming pin. As the weft yarn, or filling yarn, which ultimately becomes the MD yarn in the press fabric, is continuous, the seaming loops obtained in this manner are stronger than any that can be produced by weaving the warp ends back into the ends of a flat-woven fabric. In still another method, a fabric is woven endless, and the endless loop of fabric thereby obtained is flattened and given the form of two fabric layers joined to one another at two widthwise ends of the flattened loop. One or more widthwise yarns are then removed from each of the two widthwise ends to produce a short gap defined by the freed, that is, the newly unwoven portions of, lengthwise yarns at each end. These unwoven portions of the lengthwise yarns are then used as seaming loops when the two widthwise ends are brought together as described above.

Alternate approaches toward manufacturing a laminated fabric like that made according to the preceding method are shown in two recently issued U.S. patents. In commonly assigned U.S. Pat. No. 5,732,749 to Fargeout, the teachings of which are incorporated herein by reference, a laminated integrally woven on-machine-seamable papermaker's fabric includes two single-layer woven fabric plies sharing a common machine-direction (MD) yarn. The common MD yarn, which is the weft yarn on the loom during the weaving of the fabric by a modified endless weaving technique, forms seaming loops which join the plies to one another at the ends thereof. During the weaving of the press fabric, solvent-removable binder yarns join the two plies, which are accordingly integrally woven. When the weaving is completed, the solvent-removable binder yarn are removed through dissolution with an appropriate solvent, separating the plies and yielding the laminated structure.

In commonly assigned U.S. Pat. No. 5,939,176, the teachings of which are incorporated herein by reference, an on-machine-seamable multiaxial press fabric for the press section of a paper machine is made from a base fabric layer assembled by spirally winding a fabric strip in a plurality of contiguous turns, each of which abuts against and is attached to those adjacent thereto. The resulting endless base fabric layer is flattened to produce first and second fabric plies joined to one another at folds along their widthwise edges. Crosswise yarns are removed from each turn of the fabric strip at the folds to produce seaming loops. The press fabric is joined into endless form during installation on a paper machine by directing a pintle through the passage formed by the interdigitation of the seaming loops.

Generally, the manufacture of an on-machine-seamable press fabric includes the attachment of a staple fiber batt to one or both sides thereof. The attachment may be effected by a process called needling (fiber locking) or hydroentangling, while the fabric is joined into endless form. Once the desired amount of staple fiber batt has been attached, the loop-forming pin or pintle is removed to place the press fabric into flat form for shipment and eventual installation on a paper machine. At this time, the staple fiber batt must be cut in the vicinity of the seam to completely separate the two ends of the press fabric from one another. Often, the staple fiber batt is cut in a manner that enables it to form a flap over the seaming loops when the press fabric is rejoined into endless form. In this way, the seam region is practically indistinguishable from the rest of the paper-supporting side of the press fabric.

On the other side, the "roll" side, of the press fabric, however, some staple fiber batt must be removed from the seaming loops to facilitate the later passage of a pintle therethrough. The removal of this generally small amount of staple fiber batt, nevertheless, makes the seam region slightly more permeable to air and water than the rest of the press fabric. This difference in water permeability, or flow resistance, perhaps ever so slight, is enough to cause sheet marking in some situations. Moreover, the difference tends to become more pronounced with time as more batt fiber is lost from the "roll" side of the press fabric as it runs on the paper machine.

Several approaches to solve this problem have been taken. One approach involves the use of stuffer yarns with the pintle when the press fabric is being joined into endless form on the paper machine.

In another approach, a press fabric comprises two on-machine-seamable base fabrics, one fitting inside the loop of the other, laminated to one another during the needling process. The seam regions of the inner and outer base fabrics are offset slightly with respect to one another, so that the seam region of each will coincide with a non-seam region of the other.

All of these approaches are designed to compensate for the differences between the water permeability or flow resistance of the seam region of an OMS® press fabric and the rest or body of the press fabric. However, none of these approaches have yielded completely satisfactory results for all press types and positions and for all paper grades.

The present invention represents an alternative approach toward solving this problem.

SUMMARY OF THE INVENTION

Accordingly, the present invention is an on-machine-seamable papermaker's fabric having flow-resistant material applied over or adjacent to its seam to compensate for differences between the permeabilities to air and water of the seam and of the rest of the papermaker's fabric.

In a first embodiment of the papermaker's fabric, an on-machine-seamable base fabric has a system of longitudinal yarns and a system of transverse yarns, the former being substantially in the machine direction and the latter being substantially in the cross-machine direction. The yarns of the system of longitudinal yarns are interwoven with the yarns of the system of transverse yarns to form the base fabric in a rectangular shape with a length, a width, two lengthwise edges and two widthwise edges. The longitudinal yarns form seaming loops along each of the two widthwise edges. The seaming loops are interdigitated and joined together with a pintle to form a seam.

A strip of flow-resistant material overlies the seam and is attached thereto. The flow-resistant material provides the seam with permeabilities to air and water substantially identical to that of the rest of the papermaker's fabric. At least one layer of staple fiber batt is entangled through the base fabric.

In an alternate embodiment of the invention, the on-machine seamable papermaker's fabric has a base fabric with a laminated structure of a top layer and a bottom layer. These two layers are joined directly to one another only at their two widthwise edges by longitudinal yarns, which form seaming loops there. As above, a strip of flow-resistant material may be placed over the seam formed when the seaming loops are interdigitated with one another and joined together with a pintle. Alternatively, strips of flow-resistant material may be placed between the top layer and the bottom layer adjacent to and on each side of the seam. As above, the flow-resistant material provides the seam with permeabilities to air and water substantially identical to that of the rest of the papermaker's fabric. At least one layer of staple fiber batt is entangled through the base fabric to join the two layers to one another.

The present invention will now be described in more complete detail with frequent reference being made to the drawing figures identified below.

DETAILED DESCRIPTION OF THE PREFERRED EMBODIMENTS

Figure 1:
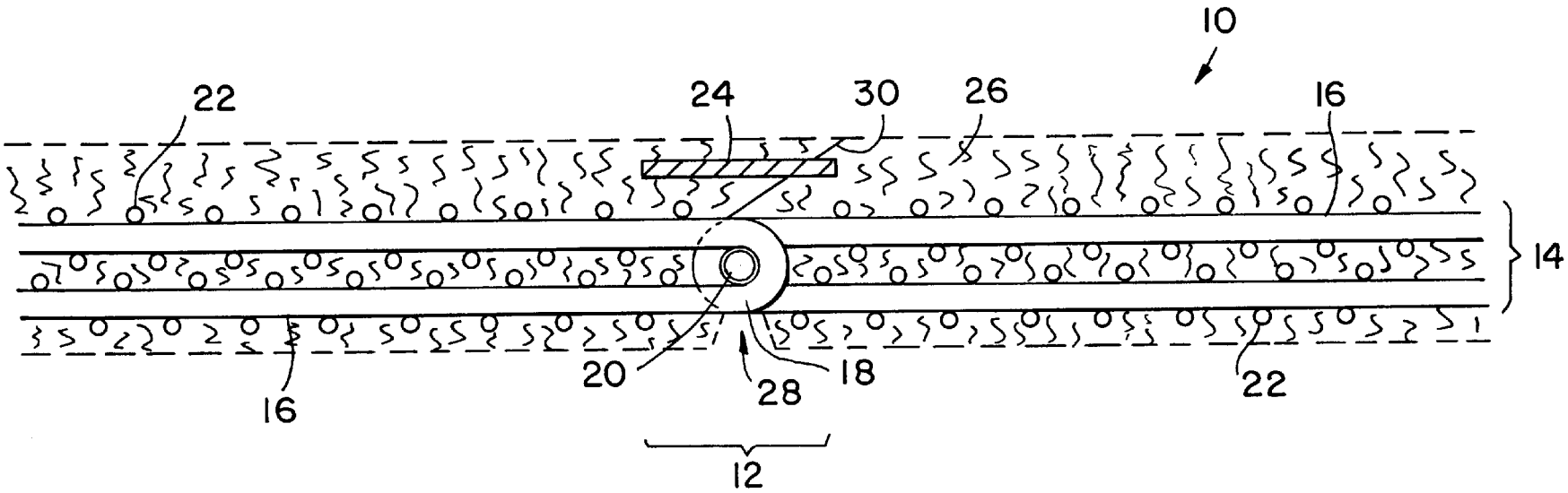
FIG. 1 is a cross-sectional view of a first embodiment of the present invention.

Referring, now, more specifically to these drawing figures, a first embodiment of the present invention is shown in FIG. 1, a cross-sectional view of the seam region 12 of an on-machine-seamable press fabric 10.

Press fabric 10 comprises a base fabric 14 which is woven from monofilament yarns in a two-layer, or duplex, weave. Machine-direction yarns 16, which are weft yarns in the on-machine-seamable base fabric 14, form seaming loops 18 which are interdigitated to create a passage through which a pintle 20 is directed to join the base fabric 14 into endless form. Cross-machine direction yarns 22, which are the warp yarns during the weaving of the base fabric 14, are, like the machine-direction yarns 16, monofilament yarns.

A strip 24 of flow-resistant material, suitable examples of which will be provided hereinbelow, is disposed over the seam region 12, straddling it by an amount in the range from 0.5 to 2.0 inches (1.27 to 5.08 cm) on its top side, and is attached thereto by sewing or by an adhesive. A batt 26 of staple fiber material is driven into the base fabric 14, including the seam region 12, by needling or hydroentanglement at least from the top side, or, optionally, from both sides. Batt 26 is subsequently cleared away from the seaming loops 18 on the bottom side of the base fabric 14, as indicated by gap 28, to provide access thereto for seaming the press fabric 10 into endless form on a paper machine. On the top side of the press fabric 10, a slit 30 is cut obliquely through the batt 26 and strip 24 of flow-resistant material to provide a flap 32 covering the seam region 12.

Figure 2:
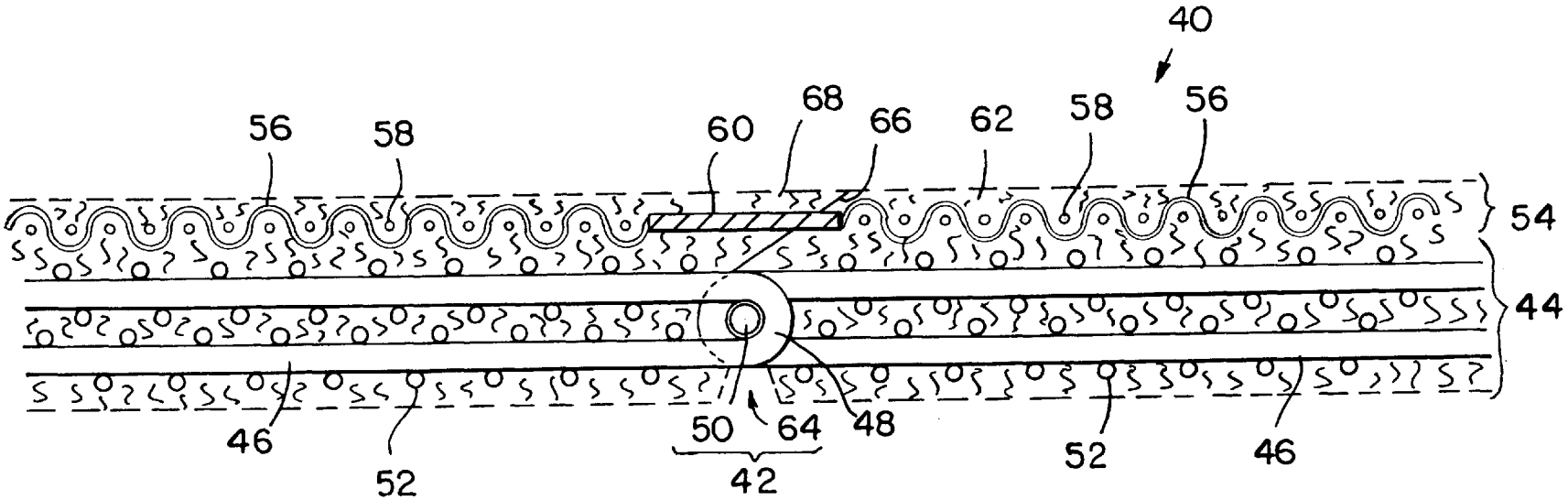
FIG. 2 is a cross-sectional view of a second embodiment of the present invention.

In an alternate embodiment, shown in FIG. 2, a cross-sectional view of the seam region 42 of an on-machine-seamable press fabric 40, press fabric 40 comprises a primary base fabric 44 of the same variety as base fabric 14 of FIG. 1. As such, primary base fabric 44 is woven from monofilament yarns in a two-layer, or duplex, weave. Machine-direction yarns 46, which are weft yarns in the on-machine-seamable primary base fabric 44, form seaming loops 48 which are interdigitated to create a passage through which a pintle 50 is directed to join the primary base fabric 44 into endless form. Cross-machine direction yarns 52, which are the warp yarns during the weaving of the primary base fabric 44, are, like the machine-direction yarns 46, monofilament yarns.

A secondary base fabric 54 is attached to the outside of the primary base fabric 44. That is to say, more specifically, secondary base fabric 54 is attached to the outer surface of the endless loop formed by the primary base fabric 44 when the latter has been seamed into that form.

Secondary base fabric 54 is of a single-layer weave, such as a plain weave, and may be joined into endless form by a woven seam, or may be woven endless. Secondary base fabric 54 is woven from machine-direction yarns 56 and cross-machine yarns 58, both of which may be monofilament yarns.

Secondary base fabric 54 is placed on top of primary base fabric 44. In other words, the endless loop formed by primary base fabric 44 is placed within the endless loop formed by the secondary base fabric 54. The primary base fabric 44 and the secondary base fabric 54 may then be attached to one another by needling an initial layer of staple fiber batt material therethrough to keep them from shifting relative to one another.

A portion, having a width in a range from 0.5 to 2.0 inches (1.27 to 5.08 cm), of the secondary base fabric 54 straddling the seam region 52 is then cut, removed and replaced by a strip 60 of flow-resistant material, which is attached thereto by sewing or by an adhesive. The desired amount of batt 62 of staple fiber material is then driven into the primary base fabric 44, secondary base fabric 54 and any initial layer of staple fiber batt material, including the seam region 42 and strip 60, by needling or hydroentanglement at least from the top side, or, optionally from both sides. Batt 62 is subsequently cleared away from the seaming loops 48 on the bottom side of primary base fabric 44, as indicated by gap 64, to provide access thereto for seaming the press fabric 40 into endless form on a paper machine. On the top side of the press fabric 40, a slit 66 is cut obliquely through the batt 62 and strip 60 of flow-resistant material to provide a flap 68 covering the seam region 42.

It should be noted that base fabric 14 of FIG. 1 and primary base fabric 44 of FIG. 2 are both woven in a two-layer, or duplex, weave using a modified endless weaving technique, as described above. As further noted above, an on-machine-seamable fabric may also be manufactured by weaving an endless loop of fabric, as shown in a perspective view in FIG. 3.

Base fabric 70 of FIG. 3 has been woven endless, and is subsequently flattened to produce a top layer 72 overlying a bottom layer 74. Each end of the flattened base fabric 70 is defined by a fold 76. One or more widthwise yarns, which are the warp yarns during the weaving process, are then removed from each of the folds at the two widthwise ends of the flattened base fabric 70. Their removal leaves a short gap defined by the freed, that is, the newly unwoven portions of, lengthwise yarns at each fold 76. The newly unwoven portions of the lengthwise yarns may then be used as seaming loops when the two widthwise ends are brought together. A similar laminated base fabric results from the practice of the invention disclosed in U.S. Pat. No. 5,732,749, as described above.

In a variation of this process, described in U.S. Pat. No. 5,939,176, an endless base fabric 80 is assembled by spirally winding a fabric strip in a plurality of contiguous turns, each of which abuts against and is attached to those adjacent thereto. The spiral winding is carried out until the width desired for the assembly has been reached, and the lateral edges of the assembly are trimmed in a direction parallel to the lengthwise direction thereof. The resulting endless base fabric 80 is shown in a perspective view in FIG. 4.

Figure 4:
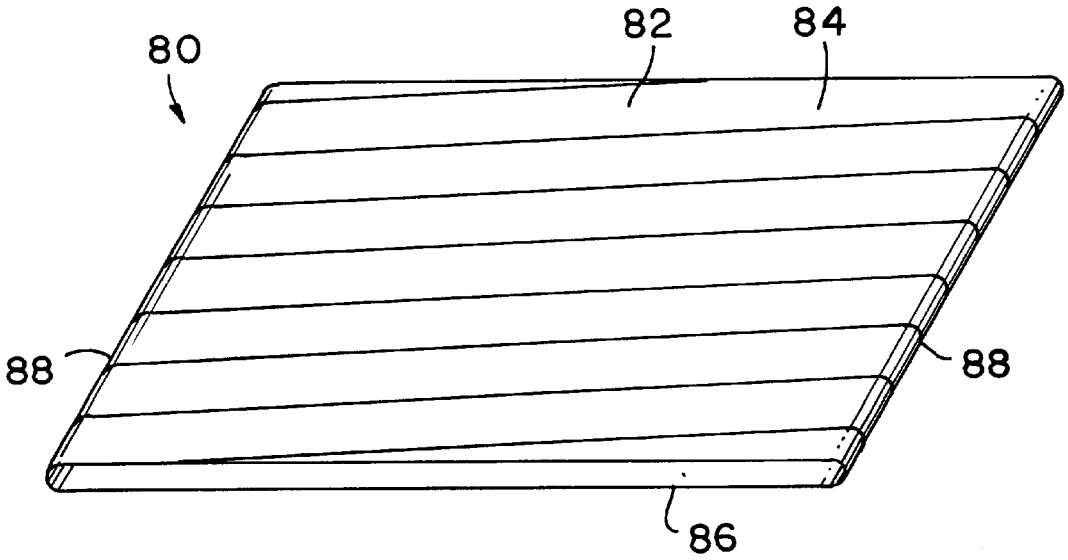
FIG. 4 is a perspective view of an endless base fabric, assembled by spirally winding a woven fabric strip, which may also be used to practice a third embodiment of the present invention.

Base fabric 80 of FIG. 4 comprises a plurality of contiguous turns of a spirally wound fabric strip 82, whose lengthwise and crosswise yarns are at slight angles, typically less than 10°, relative to the lengthwise and crosswise directions respectively, of the base fabric 80 itself. Base fabric 80 in subsequently flattened to produce a top layer 84 overlying a bottom layer 86. Each end of the flattened base fabric 80 is defined by a fold 88. One or more crosswise yarns are removed from each turn of the fabric strip 82 at the folds 88 to produce seaming loops from the newly unwoven portions of the lengthwise yarns of the fabric strip 82.

Figure 3:
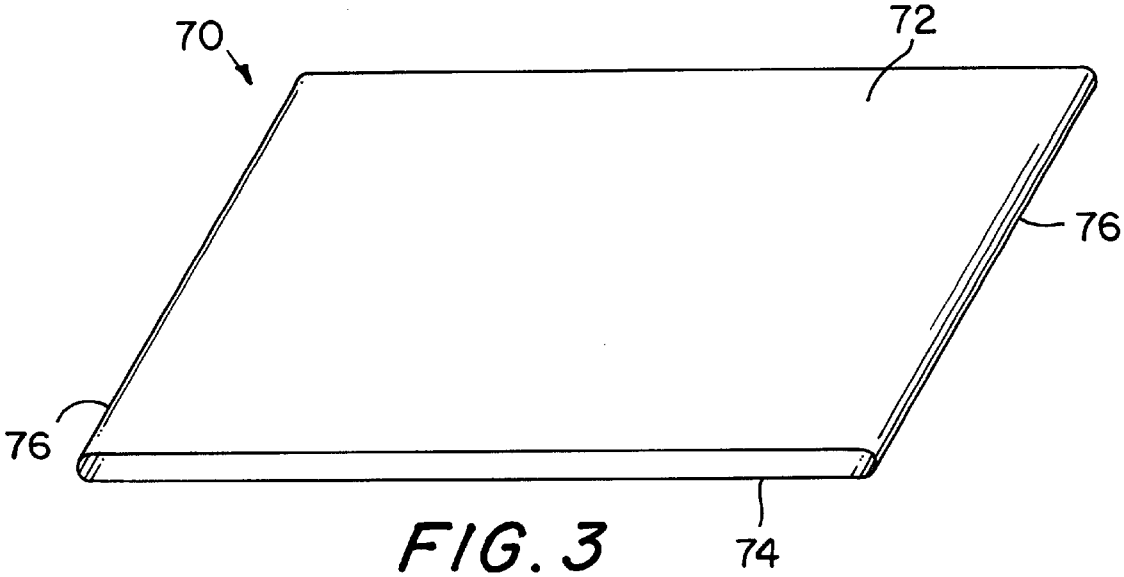
FIG. 3 is a perspective view of an endless woven fabric which may be used to practice a third embodiment of the present invention.

Laminated on-machine-seamable base fabrics 70, 80 of the types shown in FIGS. 3 and 4, as well as that obtained by practicing the invention disclosed in U.S. Pat. No. 5,732,749, may be used to practice the inventions shown in FIGS. 1 and 2. However, because each is laminated, and comprises a top fabric layer 72, 84 and a bottom fabric layer 74, 86, each may be used to practice the alternate embodiment of the invention shown in a cross-sectional view in FIG. 5.

Figure 5:
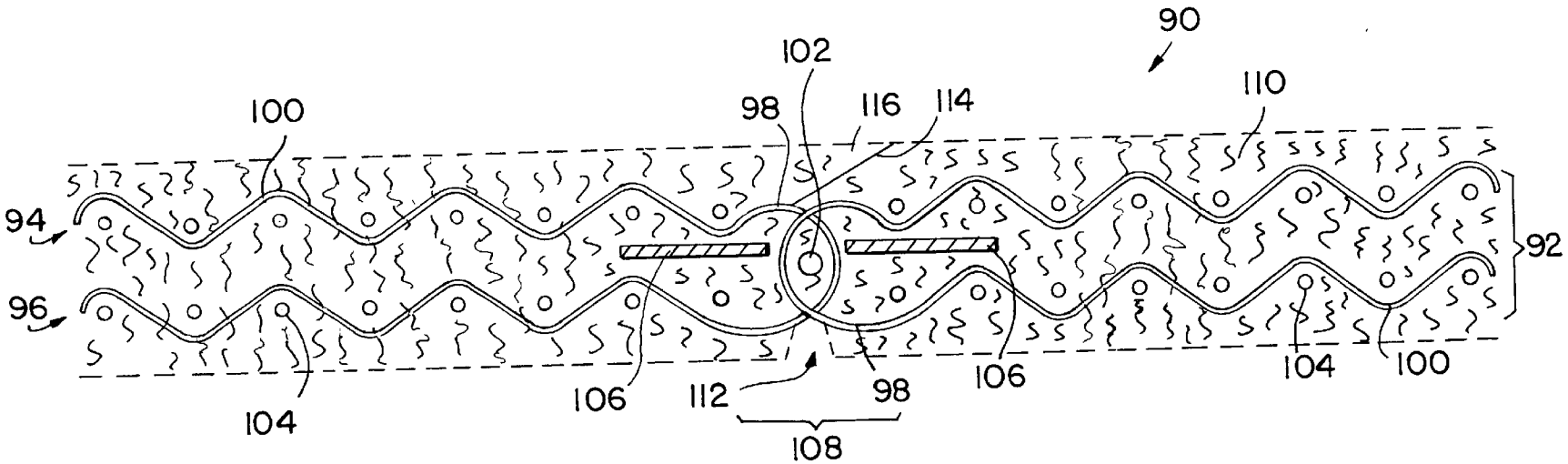
FIG. 5 is a cross-sectional view of a third embodiment of the present invention.

Referring specifically to FIG. 5, on-machine-seamable press fabric 90 comprises a laminated base fabric 92 having a top fabric layer 94 and a bottom fabric layer 96 formed by flattening an endless base fabric like those shown in FIGS. 3 and 4, and by removing some crosswise yarns from the vicinity of the folds to produce seaming loops 98 from the newly unwoven lengthwise yarns 100. It should be understood that where laminated base fabric 92 is one made from a spirally wound fabric strip, the cross-sectional view given in FIG. 5 would have to have been taken at a slight angle with respect to the machine direction of the on-machine-seamable press fabric 90.

Seaming loops 98 are interdigitated to create a passage through which a pintle 102 is directed to join the base fabric 92 into endless form. Machine-direction yarns 100 and cross-machine-direction yarns 104 may both be monofilament yarns.

A strip 106 of flow-resistant material is disposed on each side of the seam region 108 between the top and bottom fabric layers 94, 96, and may be attached there by sewing or by an adhesive. A batt 110 of staple fiber material is driven into the base fabric 92, including the seam region 108, by needling or hydroentanglement at least from the top side, or, optionally, from both sides. Batt 110 is subsequently cleared away from the seaming loops 98 on the bottom side of the base fabric 92, as indicated by gap 112, to provide access thereto for seaming the press fabric 90 into endless form on a paper machine. On the top side of the press fabric 90, a slit 114 is cut obliquely through the batt 110 to provide a flap 116 covering the seam region 108.

The strips 24, 60, 106 of flow-resistant material compensate for any inadequate flow resistance in seams 12, 42, 108 due to loss of batt fiber. The flow-resistant material may be a ribbon of fine woven or nonwoven material, or a ribbon of porous polymeric membrane applied to the seam area by sewing or adhesive prior to needling with batt fiber, or inserted between the layers of a laminated fabric, such as that shown in FIG. 5, on each side of the seam region and attached there by sewing or adhesion prior to needling with batt fiber. Polymeric foams or liquid resins may alternatively be applied instead of a ribbon or ribbons of the above-identified materials and cured to provide a desired additional flow resistance. Further alternatives will readily be apparent to those of ordinary skill in the art.

Modifications to the above would also be obvious to those of ordinary skill in the art, but would not bring the invention so modified beyond the scope of the appended claims. For example, the present invention may be practiced on on-machine-seamable press fabrics which comprise two separate on-machine-seamable base fabrics, one of which is inside the loop formed by the other. The two base fabrics are laminated to one another during the needling process, and the seam regions of the inner and outer base fabrics may be offset slightly with respect to one another, so that the seam region of each will coincide with a non-seam region of the other. The present invention would be applied to the outer of the two base fabrics, that being closer to the paper web when the press fabric is in use on a paper machine.

What is claimed is:

1. An on-machine-seamable papermaker's fabric comprising:

a base fabric, said base fabric having a system of longitudinal yarns and a system of transverse yarns, said longitudinal yarns being substantially in the machine direction of said base fabric and said transverse yarns being substantially in the cross-machine direction of said base fabric, said yarns of said system of longitudinal yarns being interwoven with said yarns of said system of transverse yarns to form said base fabric in a rectangular shape with a length, a width, two lengthwise edges and two widthwise edges, said longitudinal yarns forming seaming loops along each of said two widthwise edges, said seaming loops being interdigitated and joined together with a pintle to form a seam;

a strip of flow-resistant material over said seam and attached thereto, said flow-resistant material providing said seam with permeabilities to air and water substantially identical to those of the rest of said papermaker's fabric; and at least one layer of staple fiber batt entangled through said base fabric.

2. An on-machine-seamable papermaker's fabric as claimed in claim 1 wherein said base fabric comprises a top layer and a bottom layer, said yarns of said system of longitudinal yarns being interwoven with some of said yarns of said system of transverse yarns to form said top layer and with the remainder of said yarns of said system of transverse yarns to form said bottom layer, said yarns of said system of longitudinal yarns alternating from said top layer to said bottom layer, and vice versa, at said two widthwise edges, when so alternating, forming said seaming loops, said base fabric thereby being a laminated structure having two woven plies joined to one another by said seaming loops along said two widthwise edges, and wherein said at least one layer of staple fiber batt joins said top layer to said bottom layer.

3. An on-machine-seamable papermaker's fabric as claimed in claim 1 wherein said base fabric comprises a top layer and a bottom layer fashioned from an endless base fabric layer comprising a fabric strip having a first lateral edge, a second lateral edge, a plurality of longitudinal yarns and a plurality of transverse yarns, said fabric strip being spirally wound in a plurality of contiguous turns wherein said first lateral edge in a given turn of said fabric strip abuts said second lateral edge of an adjacent turn thereof, thereby forming a helically continuous seam separating adjacent turns of said fabric strip, said helically continuous seam being closed by attaching abutting first and second lateral edges of said fabric strip to one another, thereby providing said base fabric layer in the form of an endless loop having a machine direction and a cross-machine direction, said endless base fabric layer being flattened to produce said top layer and said bottom layer having two widthwise edges, said top layer and said bottom layer being connected to one another at folds along said two widthwise edges, at least one transverse yarn in each of said turns of said fabric strip being removed at each of said folds at said two widthwise edges to provide unbound sections of longitudinal yarns of said fabric strip at said folds, said unbound sections being said seaming loops, said base fabric thereby being a laminated structure having two layers joined to one another by said seaming loops along said two widthwise edges, and wherein said at least one layer of staple fiber batt joins said top layer to said bottom layer.

4. An on-machine-seamable papermaker's fabric as claimed in claim 1 wherein said flow-resistant material is a ribbon of woven material.

5. An on-machine-seamable papermaker's fabric as claimed in claim 1 wherein said flow-resistant material is a ribbon of nonwoven material.

6. An on-machine-seamable papermaker's fabric as claimed in claim 1 wherein said flow-resistant material is a ribbon of polymeric film.

7. An on-machine-seamable papermaker's fabric as claimed in claim 1 wherein said flow resistant material is a polymeric foam.

8. An on-machine-seamable papermaker's fabric as claimed in claim 1 wherein said flow-resistant material is a cured liquid resin.

9. An on-machine-seamable papermaker's fabric comprising:

a base fabric, said base fabric having a rectangular shape with a length, a width, two lengthwise edges, and two widthwise edges, said base fabric having a system of longitudinal yarns and a system of transverse yarns, said longitudinal yarns being substantially in the machine direction of said base fabric and said transverse yarns being substantially in the cross-machine direction of said base fabric, said base fabric having a top layer and a bottom layer joined to one another only at said two widthwise edges by said longitudinal yarns, said longitudinal yarns forming seaming loops along each of said two widthwise edges, said seaming loops being interdigitated and joined together with a pintle to form a seam;

a strip of flow-resistant material between said top layer and said bottom layer on at least one side of said seam, said flow-resistant material providing said seam with permeabilities to air and water substantially identical to that of the rest of said press fabric; and at least one layer of staple fiber batt entangled through said base fabric and joining said top layer to said bottom layer.

10. An on-machine-seamable papermaker's fabric as claimed in claim 9 wherein said yarns of said system of longitudinal yarns are interwoven with some of said yarns of said system of transverse yarns to form said top layer and with the remainder of said yarns of said system of transverse yarns to form said bottom layer, said yarns of said system of longitudinal yarns alternating from said top layer to said bottom layer, and vice versa, at said two widthwise edges, when so alternating, forming said seaming loops.

11. An on-machine-seamable papermaker's fabric as claimed in claim 9 wherein said base fabric is fashioned from an endless base fabric layer comprising a fabric strip having a first lateral edge, a second lateral edge, a plurality of longitudinal yarns and a plurality of transverse yarns, said fabric strip being spirally wound in a plurality of contiguous turns wherein said first lateral edge in a given turn of said fabric strip abuts said second lateral edge of an adjacent turn thereof, thereby forming a helically continuous seam separating adjacent turns of said fabric strip, said helically continuous seam being closed by attaching abutting first and second lateral edges of said fabric strip to one another, thereby providing said base fabric layer in the form of an endless loop having a machine direction and a cross-machine direction, said endless base fabric layer being flattened to produce said top layer and said bottom layer having two widthwise edges, said top layer and said bottom layer being connected to one another at folds along said two widthwise edges, at least one transverse yarn in each of said turns of said fabric strip being removed at each of said folds at said two widthwise edges to provide unbound sections of longitudinal yarns of said fabric strip at said folds, said unbound sections being said seaming loops.

12. An on-machine-seamable papermaker's fabric as claimed in claim 9 wherein said flow-resistant material is a ribbon of woven material.

13. An on-machine-seamable papermaker's fabric as claimed in claim 9 wherein said flow-resistant material is a ribbon of nonwoven material.

14. An on-machine-seamable papermaker's fabric as claimed in claim 9 wherein said flow-resistant material is a ribbon of polymeric film.

15. An on-machine-seamable papermaker's fabric as claimed in claim 9 wherein said flow-resistant material is a polymeric foam.

16. An on-machine-seamable papermaker's fabric as claimed in claim 9 wherein said flow-resistant material is a cured liquid resin.

* * * * *